US008146309B1

(12) United States Patent
Logemann et al.

(10) Patent No.: US 8,146,309 B1
(45) Date of Patent: Apr. 3, 2012

(54) CONCRETE CRACK INDUCER WITH DRAINAGE CHANNEL

(75) Inventors: David Keith Logemann, Earlham, IA (US); Neal Gene Logemann, Earlham, IA (US)

(73) Assignee: Concrete Joint Ventures, LLC, Earlham, IA (US)

( * ) Notice: Subject to any disclaimer, the term of this patent is extended or adjusted under 35 U.S.C. 154(b) by 223 days.

(21) Appl. No.: 12/248,308

(22) Filed: Oct. 9, 2008

Related U.S. Application Data

(60) Provisional application No. 60/979,214, filed on Oct. 11, 2007.

(51) Int. Cl.
*E04B 1/64* (2006.01)

(52) U.S. Cl. ..... 52/396.02; 404/64

(58) Field of Classification Search ..... 52/318, 52/368, 396.02, 396.04–396.06; 404/2, 49, 404/51, 53, 55, 64, 74
See application file for complete search history.

(56) References Cited

U.S. PATENT DOCUMENTS

| | | | | | |
|---|---|---|---|---|---|
| 1,613,351 | A | | 1/1927 | Klinger et al. | |
| 1,921,081 | A | * | 8/1933 | Heltzel | 404/51 |
| 2,027,201 | A | | 1/1936 | Robertson | |
| 2,100,238 | A | * | 11/1937 | Burgess | 52/393 |
| 2,239,933 | A | | 4/1941 | Robertson | |
| 2,254,885 | A | | 9/1941 | Carswell et al. | |
| 2,309,538 | A | | 1/1943 | Robertson | |
| 2,329,189 | A | | 9/1943 | Dill | |
| 2,806,414 | A | * | 9/1957 | Woodman | 404/2 |
| 3,368,464 | A | * | 2/1968 | Thorp, Jr. et al. | 404/74 |
| 3,434,401 | A | | 3/1969 | Kiewit | |
| 3,567,816 | A | | 3/1971 | Embree | |
| 3,575,094 | A | | 4/1971 | Hewitt et al. | |
| 3,830,032 | A | | 8/1974 | Robb | |
| 3,871,787 | A | | 3/1975 | Stegmeier | |
| 3,873,220 | A | | 3/1975 | Kashiwabara | |
| 3,994,471 | A | | 11/1976 | Turolla | |
| 4,128,358 | A | * | 12/1978 | Compton | 404/47 |
| 4,144,685 | A | | 3/1979 | Fox | |
| 4,175,978 | A | | 11/1979 | Marzocchi et al. | |
| 4,329,080 | A | | 5/1982 | Elley | |
| 4,388,016 | A | * | 6/1983 | Levey | 404/48 |
| 4,522,531 | A | * | 6/1985 | Thomsen et al. | 404/2 |
| 4,548,009 | A | | 10/1985 | Dahowski | |
| 4,574,017 | A | | 3/1986 | Stegmeier | |

(Continued)

OTHER PUBLICATIONS

Cable, James K, et al., "Evaluation of Transverse Joint Forming Methods for PCC Pavement", National Concrete Pavement Technology Center, IHRB Project TR-532 Final Report (Jan. 2006).

*Primary Examiner* — Robert Canfield
*Assistant Examiner* — Christine T Cajilig
(74) *Attorney, Agent, or Firm* — Zarley Law Firm, P.L.C.

(57) ABSTRACT

A plastic extruded member is provided which will induce cracks in concrete and provide drainage for moisture entering the cracks. The member includes a base which sets upon the subgrade surface, with a pair of legs extending upwardly from the base. Arms extend laterally outwardly from each leg. As extruded, the legs are adjacent one another, and then spread apart as the concrete cures and shrinks, thereby inducing a substantially vertical crack in the concrete above the legs. The member includes a drain channel at the lower end of the legs. The gap between the legs which is created by the shrinking cured concrete provides a path from the crack to the drain channel for draining water entering the crack.

21 Claims, 7 Drawing Sheets

U.S. PATENT DOCUMENTS

| | | | | |
|---|---|---|---|---|
| 4,651,488 | A * | 3/1987 | Nicholas et al. | 52/396.02 |
| 4,669,245 | A | 6/1987 | Lucas | |
| 4,682,461 | A | 7/1987 | Sizemore | |
| 4,815,886 | A | 3/1989 | Madsen | |
| 4,835,933 | A | 6/1989 | Yung | |
| 4,841,704 | A | 6/1989 | Jarrell | |
| 4,889,445 | A | 12/1989 | Vittone | |
| 4,953,340 | A | 9/1990 | Anderson | |
| 5,042,211 | A | 8/1991 | Nestler | |
| 5,337,532 | A | 8/1994 | Reid | |
| 5,586,416 | A | 12/1996 | Hess, III et al. | |
| 5,729,949 | A | 3/1998 | Hartzheim | |
| 5,736,676 | A | 4/1998 | Stelter et al. | |
| 5,831,212 | A | 11/1998 | Whitehead et al. | |
| 5,857,302 | A | 1/1999 | Lill | |
| 5,918,428 | A | 7/1999 | Hough | |
| 5,956,912 | A | 9/1999 | Carter et al. | |
| 6,089,522 | A | 7/2000 | Haslem et al. | |
| 6,092,960 | A | 7/2000 | McCallion | |
| 6,112,494 | A | 9/2000 | Hardy, Jr. et al. | |
| 6,171,016 | B1 | 1/2001 | Pauls et al. | |
| 6,279,274 | B1 | 8/2001 | Amiet et al. | |
| 6,413,004 | B1 | 7/2002 | Lin | |
| 6,447,203 | B1 | 9/2002 | Ruiz et al. | |
| 7,028,444 | B2 | 4/2006 | Wirth | |
| 7,069,703 | B2 | 7/2006 | Colefax et al. | |
| 7,308,892 | B2 * | 12/2007 | Cockerell | 125/23.01 |
| 2006/0000174 | A1 * | 1/2006 | Edgman | 52/396.02 |

* cited by examiner

CONCRETE CRACK INDUCER WITH DRAINAGE CHANNEL

CROSS-REFERENCE TO RELATED APPLICATIONS

This application claims priority under 35 U.S.C. §119(e) to provisional application Ser. No. 60/979,214 filed Oct. 11, 2007, herein incorporated by reference in its entirety.

BACKGROUND OF THE INVENTION

After concrete is poured, it shrinks as it cures. Such shrinkage inherently causes cracking in the concrete at arbitrary locations and spacing. It is desirable to control the location of such cracking. For example, it is common to cut a slot in the upper surface of a partially cured roadway or sidewalk so as to force a crack beneath the cut. Sawing concrete is an extensive time and labor process. The cuts must be made at the proper time in the curing process, so as to avoid chipping of concrete around the soft cut, cracking at improper locations, and micro cracking around the saw cuts. The saw cuts must also be provided in the proper locations so as to avoid additional, undesirable cracking. Furthermore, saw cutting equipment, including the blades, are costly to buy and maintain. The cutting process also generates substantial dust which must be cleaned away, and which may raise health concerns with excessive inhalation of the dust. Operation of the saw cutting equipment also requires training so as to maintain safety. Saw cutting also causes loss of aggregate interlock at the top of the concrete pavement.

Various prior art devices have been inserted into the wet concrete for inducing cracks as the concrete cures, so that the location of the cracks can be controlled. However, it often is difficult to reach desired locations for such inserts, depending on the size of the concrete slab and location of the insert.

Also, unless sealed, water seeps into the cracks. In freezing conditions, it expands as it turns to ice, thereby breaking the concrete adjacent the cuts and cracks, thereby damaging the concrete surface. Sealing the cracks to preclude such freeze breakage of the concrete adds costs for material and labor. Also, sealing often must be periodically repeated due to shrinkage, drying and/or cracking of the sealing material.

Accordingly, a primary objective of the present invention is the provision of a device for inducing cracks at pre-selected locations in concrete and providing a drainage channel for water seeping into the cracks.

Another objective of the present invention is the provision of a device for inducing cracks in concrete and draining water from the cracks which is set on the concrete bed before the concrete is poured.

A further objective of the present invention is the provision of a concrete crack inducing and draining device which is simple to install.

Still another objective of the present invention is the provision of a concrete crack inducing and draining device which is effective in use.

Yet another objective of the present invention is the provision of a concrete crack inducing and draining device which supports concrete forms, such as 2×4's.

A further objective of the present invention is the provision of a concrete crack inducing and draining device which supports strengthening structures, such as dowels and re-bar.

Another objective of the present invention is the provision of a device for inducing cracks in concrete and providing drainage, wherein multiple devices can be assembled in parallel and/or perpendicular orientations.

Still another objective of the present invention is the provision of a device for inducing cracks in concrete and providing drainage which is economical to manufacture and durable in use.

These and other objectives will become apparent from the following description of the invention.

SUMMARY OF THE INVENTION

An extruded member is provided which is secured to the subgrade or prepared bed prior to pouring of the concrete. The extruded member can be properly positioned on the subgrade for use in both reinforced and plain concrete slabs or pavements. The extrusion member can be positioned below load transfer devices, such as dowels and re-bar, with or without baskets. After the extrusion is set in place, the concrete is poured over the extrusion, which causes a weak vertical plane in the concrete during the curing process. As the concrete shrinks during curing, a joint/crack will occur directly above the extrusion member. Tabs or arms on the extrusion member are secured within the concrete, whereby the shrinking action of the concrete causes the legs of the extrusion member to spread apart, thereby opening a channel at the bottom of the extrusion member. The opened channel allows any water that seeps into the crack to drain out the ends of the extrusion member for discharge to a desired location.

Multiple extrusion members can be fastened together using connectors, which also allow free water drainage through the individual extruded pieces.

The extruded member may include a notch for receiving a forming member, such as a 2×4. Smaller notches or holes may be made in the member for supporting re-bar and/or dowels to strengthen the concrete and concrete joints.

The extrusion members eliminate the need for saw cutting in the concrete, and eliminates the need for joint sealant in cut slots. The extrusions also prevent soft wet subgrade fines from being pumped upwardly through a formed joint, which can lead to faulting. The extrusions allow for horizontal movement of the concrete due to shrinkage and thermal volume changes. The extrusions provide a vertical support to transfer traffic loads across the joint, thereby reducing joint deflection and faulting. The extrusions minimize joint opening width at the concrete surface, which maximizes aggregate interlock and load transfer as traffic loading compresses the top of the joint. The minimized joint opening which results from use of the extrusions also provides for a smoother upper surface for the concrete. The minimal joint width above the extrusions also reduces traffic noise.

DETAILED DESCRIPTION OF THE PREFERRED EMBODIMENT

Figure 1:
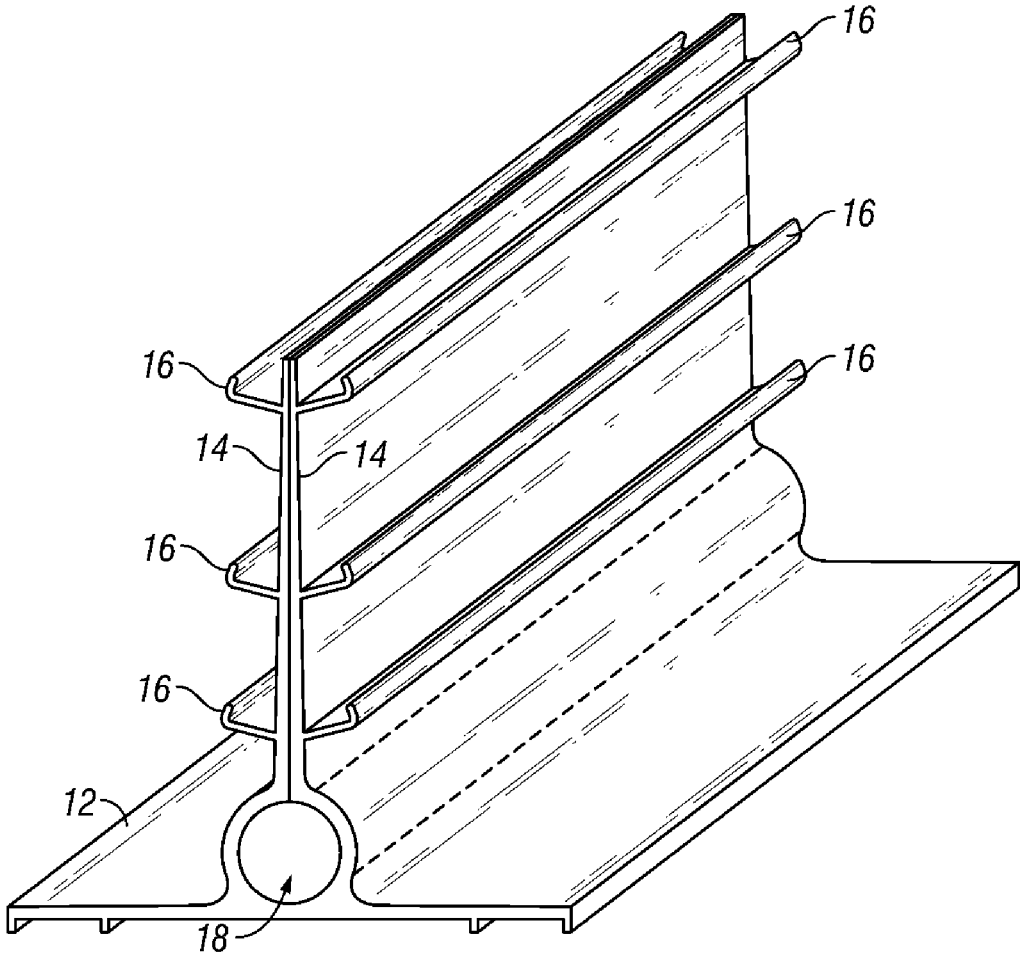
FIG. 1 is a perspective view of the crack inducing end elevation view of the device of the present invention having a drainage channel therein.
Figure 2:
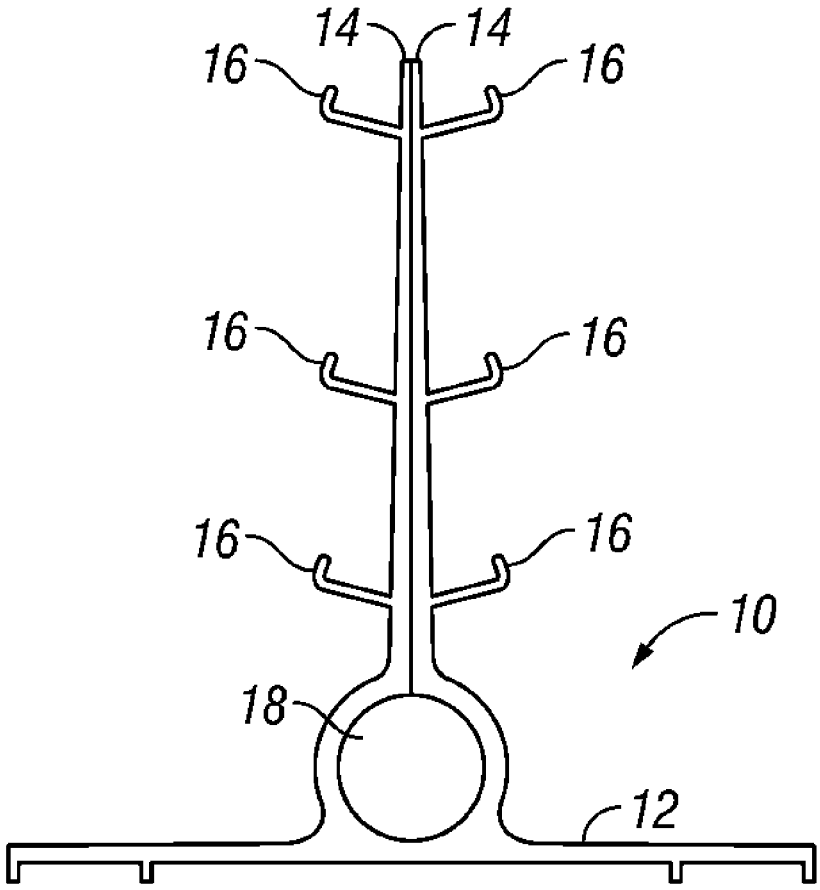
FIG. 2 is another end elevation view of the device as extruded, before the concrete cures.
Figure 3:
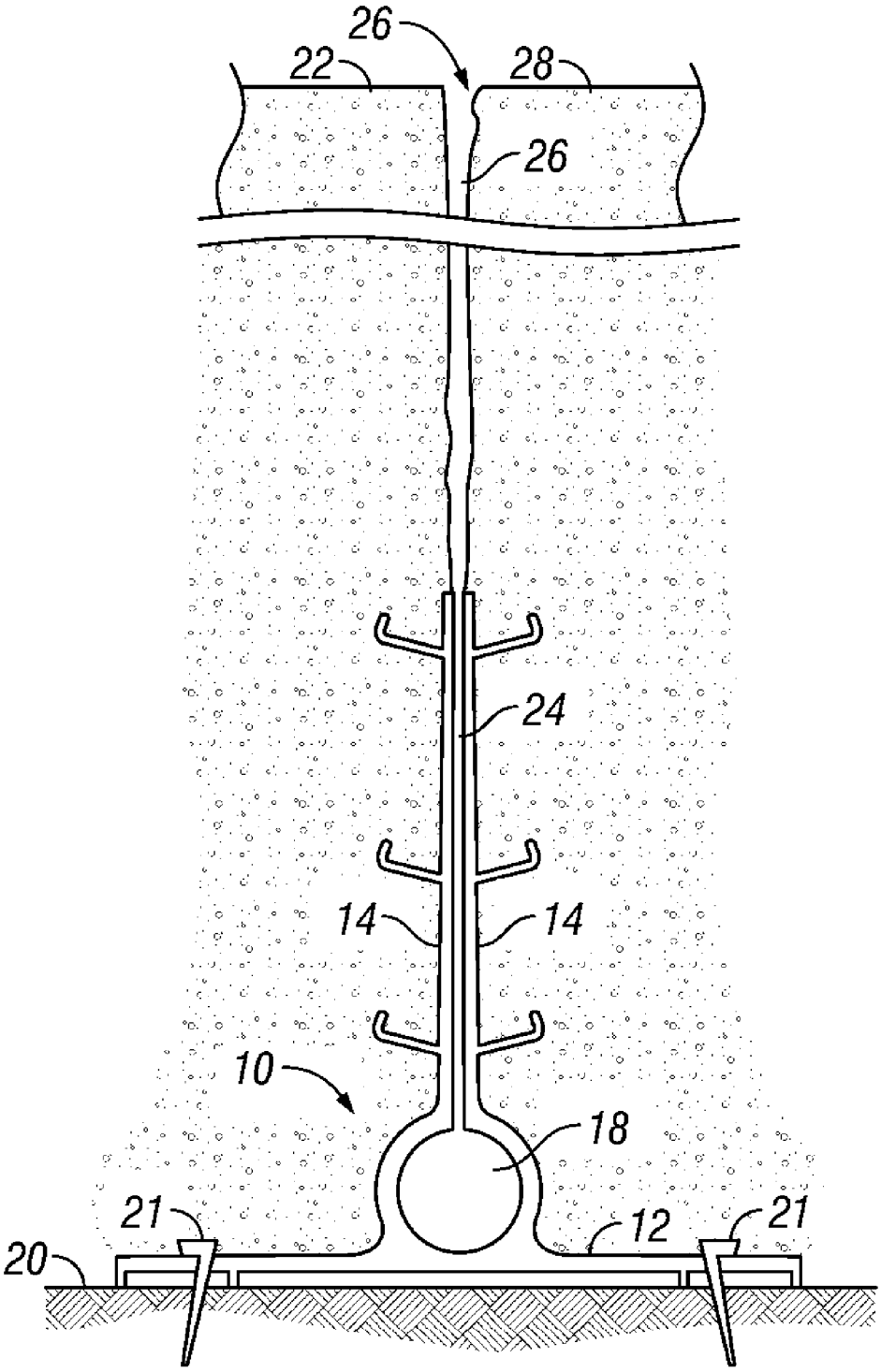
FIG. 3 is an end elevation view of the device in use, after the concrete cures.
Figure 4:
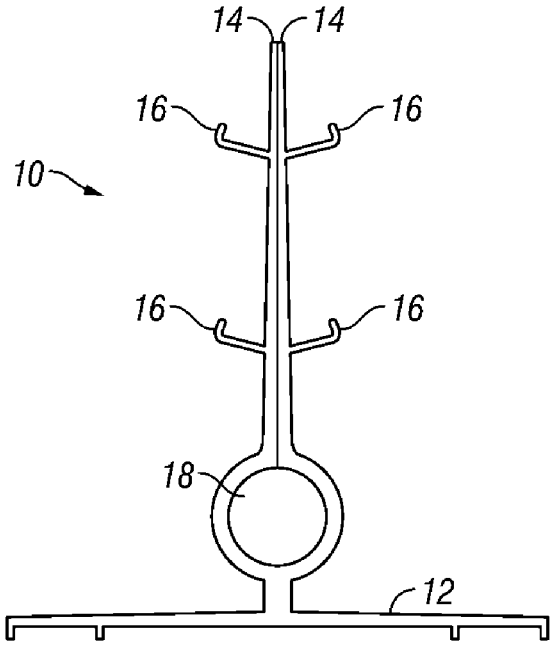
FIG. 4 is an end elevation view of an alternative form of the device.
Figure 5:
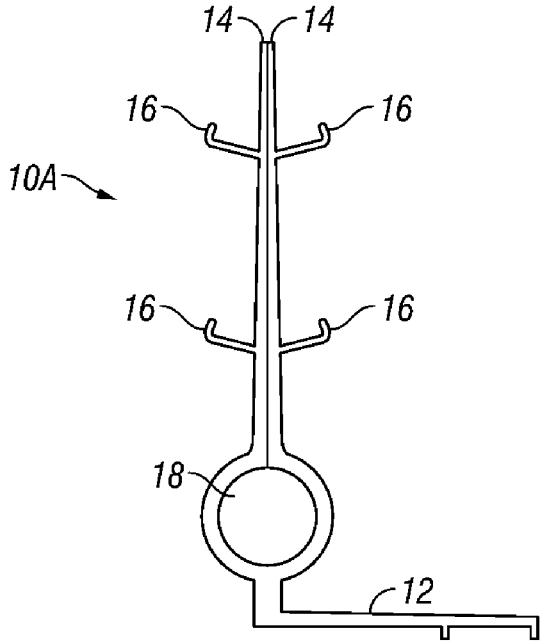
FIG. 5 is an end elevation view of yet another embodiment of the device.

The concrete crack inducing and draining device 10 of the present invention is preferably an extruded plastic member having a base 12 and a pair of upstanding legs 14 which taper as they extend upward. In one embodiment, the device 10 has an inverted T-shape, as seen in FIGS. 1-4 and 8-10. In an alternative embodiment, the device 10A has an L-shape as seen in FIG. 5. A plurality of arms 16 extend outwardly from each leg. A drain channel 18 is formed in the member 10, 10A. In one embodiment, the drain channel 18 is adjacent the base 12, as seen in FIGS. 1-3, while in another embodiment the drain channel 18 is spaced above the base 12, as seen in FIGS. 4 and 5. As extruded, the legs 14 engage or abut one another, as seen in FIGS. 1, 2, 4 and 5.

The device 10, 10A is adapted for use in roadways, sidewalks, floor slabs, and other concrete environments. In use, the device 10, 10A is set upon the ground, subgrade, or road bed 20 upon which concrete is to be poured. The base 12 may be pinned to the subgrade 20 using a stake 21, if desired, to keep the device 10, 10A from sliding or shifting. The width of the base 12 keeps the device 10 from tipping. The concrete 22 is poured onto the surface 20 over the device 10, 10A. The arms 16 preferably are angled slightly upwardly so that the concrete flows over and under the arms 16, as depicted in FIG. 3, without formation of air pockets. As the concrete cures, the natural shrinkage of the concrete pulls the legs 14 apart so as to define a gap 24 between the legs 14. The gap 24 extends the full height of the legs 14, and induces a crack 26 in the concrete 22. The crack 26 extends from the upper surface 28 of the concrete 22 and downwardly through the gap 24 for communication with the drainage channel 18. Thus, water seeping into the crack 26 can flow into the channel 18 for drainage. Thus, the drain channel 18 removes water from the cracks 26 before the water can freeze and cause damage to the concrete 22.

Figure 11:
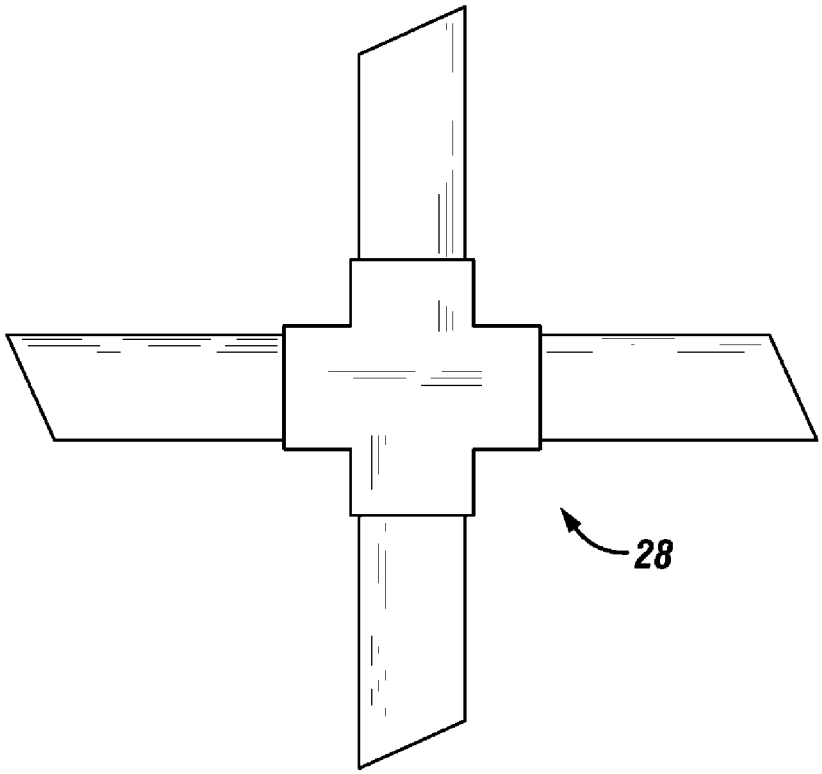
FIG. 11 is an elevation view of a connector used to join four extruded members at a crossing intersection.

The device 10, 10A can be extruded and/or cut to any desired length. For example, in a roadway application, the member 10, 10A may be 12 feet or longer, so as to extend across the full width of the road. Multiple devices 10, 10A may be connected to one another using a hollow tube connector 28. For example, FIG. 11 show a cross-shaped connector 28 used to connect four devices 10, 10A at an intersection. A straight-line connector can be used to connect two devices 10, 10A axially in an end to end relation, without a perpendicular connection. An L-shaped connector can be used for joining two devices at right angles.

The device 10, 10A is preferably an extruded plastic material. However, it is understood that other materials can be utilized, including metal, fiberglass, and non-extruded plastics. The shape and dimensions of the device 10, 10A may vary from that shown in the drawings. The number of arms 16 provided on the device 10, 10A may also be varied. Preferably, the height of the device 10, 10A is approximately ⅓ the depth of the concrete.

The legs 14 of the device 10, 10A are initially positioned together during the pouring process, so as to prevent concrete from migrating between the legs 14. As the concrete cures, the legs 14 will be pulled apart via the arms 16 on the legs 14. Once the legs 14 are pulled apart, the channel 18 is opened so as to allow water that enters the shrinkage crack to drain into the device 10, 10A for discharge at the edge of the roadway or slab. Elbows or extensions can be connected to the device 10, 10A so as to extend the drainage to a location spaced from the edge of the concrete.

Figure 6:
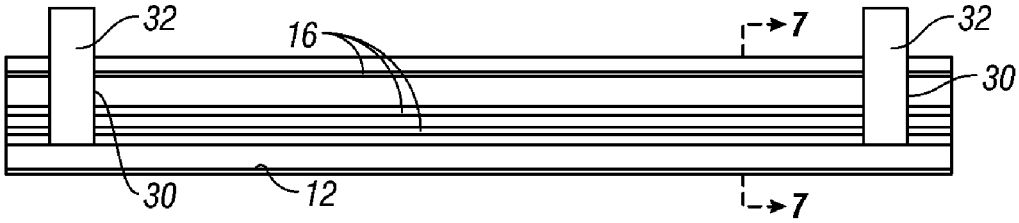
FIG. 6 is a side elevation view of yet another embodiment of the device having a notch formed adjacent the opposite ends for receiving a forming board, such as a 2×4.
Figure 7:
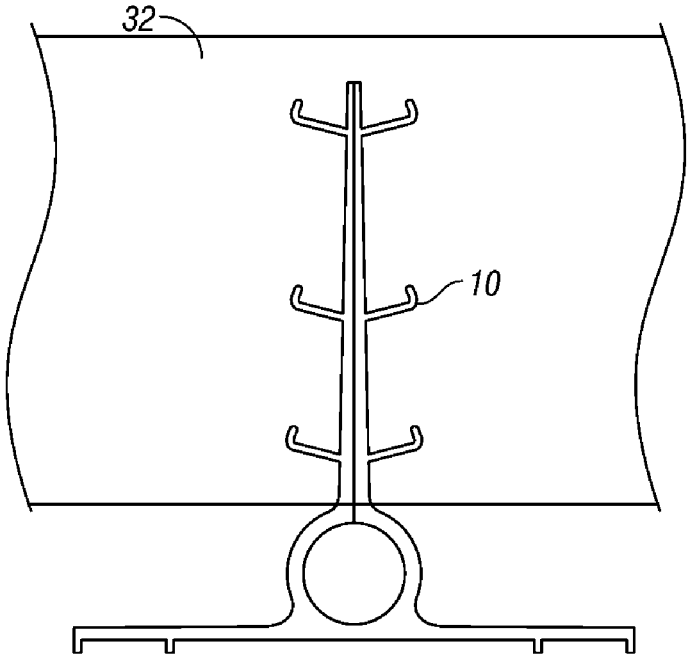
FIG. 7 is a sectional view taken along line 7-7 of FIG. 6.

Another embodiment of the device 10, 10A is shown in FIGS. 6 and 7, wherein notches 30 are provided adjacent the opposite ends of the extruded member 10, 10A. The notches are adapted to hold a concrete forming structure, such as a 2×4 board 32. The wet concrete can then be poured in a conventional manner on top of the subgrade 20 between the boards 32 to form a sidewalk or other desired slab.

Figure 8:
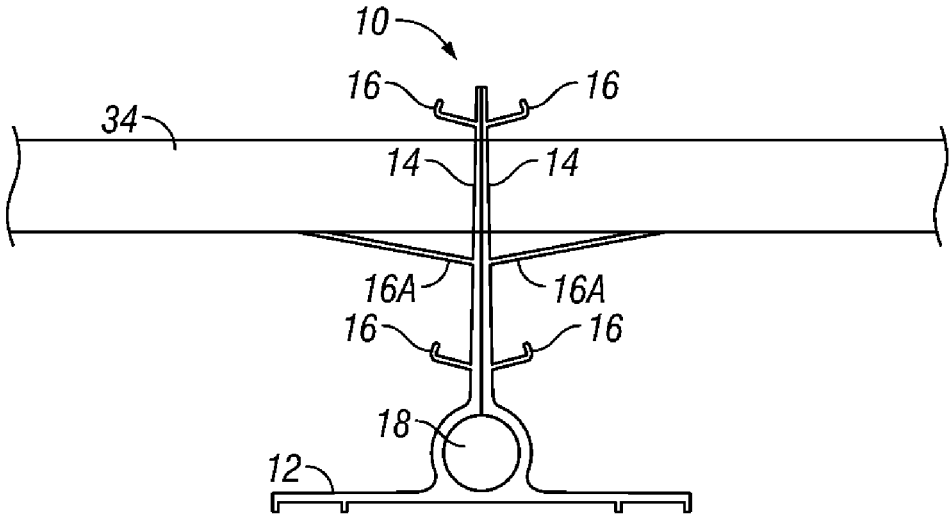
FIG. 8 is an end view of another embodiment of the device shown supporting a dowel rod used at the joint between adjacent concrete slabs.

The device 10, 10A can also be used to support strengthening members employed in the concrete, such as dowels and re-bar or re-rod. For example, as seen in FIG. 8, a dowel 34, which is often used to span the joint between adjacent slabs so as to strengthen the joint, is supported by the device 10, 10A. The dowel 34 is received in a notch formed in the top of the device 10, 10A or through a hole extending through the legs 14. As shown in FIG. 8, the middle pair of arms 16A are extending in length to provide further support for the dowel 34.

Figure 9:
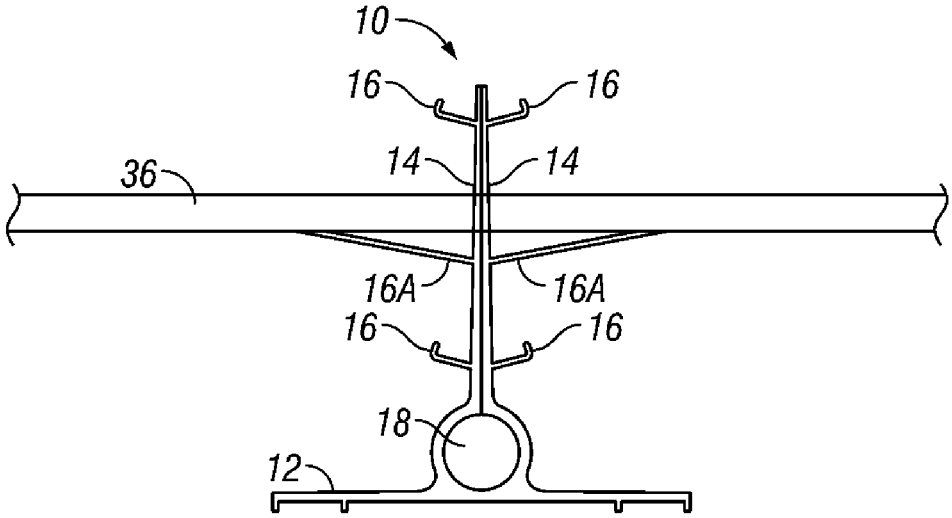
FIG. 9 is a view similar to FIG. 8 showing the device supporting a concrete strengthening element, such as a re-bar or re-rod.

Similarly, as shown in FIG. 9, re-bar 36 is supported by the device 10, 10A. Re-bar 36 may reside in a notch or slot extending downwardly from the top edge of the legs 14 or through a hole formed through the legs 14. The extended arms 16A provide additional support for the re-bar 36.

Figure 10:
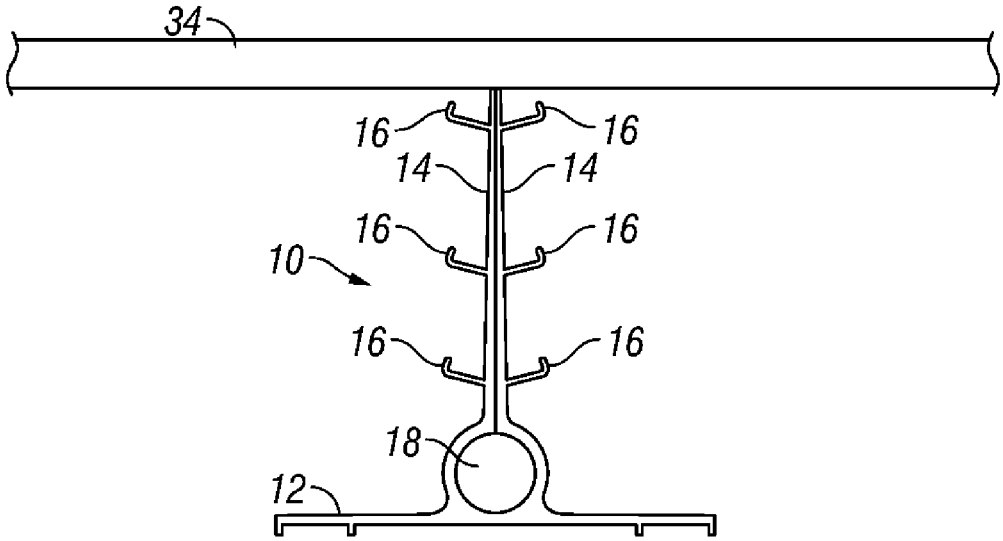
FIG. 10 is an end elevation view of the device shown in FIG. 1 supporting a dowel rod on top of the legs of the device.

As a further alternative, a dowel 34, or re-bar may be supported on the top of the legs 14, as shown in FIG. 10.

Thus, with the uses of the device shown in FIGS. 8-10, conventional baskets and other support structure for dowels and re-bar may be eliminated by the use of the device 10.

It is understood that the drawings are not made to scale.

Bentonite or other similar material which swells when moistened, may be provided in the drain channel 18 before the device 10, 10A is set upon the bed or subgrade 20. After the crack is induced, water can be poured into the crack for reaction with the bentonite, which then swells upwardly through the gap 24 and the crack 26 to the surface of the concrete, thereby sealing the crack 26 against further penetration from additional moisture.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A device for inducing cracking and providing drainage in concrete, comprising:

an extruded member having an integrally formed base, a pair of legs and drain channel;

the base having a flat bottom to sit upon a bed upon which concrete is to be poured such that the device is self-standing;

the pair of legs each having a planar face extending a length upwardly from the base to a top edge;

the drain channel between the base and the legs and having at least one open end to drain fluid from the channel;

wherein the legs initially engage one another along the planar face and then spread apart as the concrete cures so as to induce a crack in the concrete and to define a gap between the legs communicating with the drainage channel to drain moisture which enters the crack;

wherein the drain channel is integrally formed into the extruded member between the base and the legs from a lower end of each of the legs to a top surface of the base which extends outwardly from a bottom of the drain channel; and a stake extending through the base to secure the device on the bed.

2. The device of claim 1 wherein the legs are adapted to reside beneath the surface of the concrete.

3. The device of claim 1 wherein each leg includes at least one arm extending laterally outwardly and slightly upwardly from the leg.

4. The device of claim 1 wherein the base and legs form an inverted T cross-section.

5. The device of claim 1 wherein the base and legs form an L cross-section.

6. The device of claim 1 wherein the drain channel is adjacent the base.

7. The device of claim 1 wherein the base, legs and drain channel are formed as one piece.

8. The device of claim 1 wherein the base, legs and drain channel are an extruded unit.

9. The device of claim 1 further comprising a second identical device and a connector to connect the devices together.

10. The device of claim 9 wherein the devices are connected end to end.

11. The device of claim 9 wherein the devices are connected at right angles.

12. The device of claim 1 wherein the legs include a notch to receive a concrete forming member, a re-bar, or a dowel.

13. The device of claim 1 wherein the drain channel is cylindrical.

14. The device of claim 1 wherein the legs taper as they extend upwardly.

15. The device of claim 1 wherein the legs are narrower at their top edge than they are at their base.

16. A device for inducing cracking and providing drainage in concrete, comprising:

a base having a flat bottom to sit upon a bed upon which concrete is to be poured such that the device is self-standing;

a pair of legs having a planar face extending a length upwardly from the base;

a drain channel between the base and the legs and having at least one open end to drain fluid from the channel;

wherein the legs initially engage one another along the planar face and then spread apart as the concrete cures so as to induce a crack in the concrete and to define a gap between the legs communicating with the drainage channel to drain moisture which enters the crack;

wherein the drain channel is spaced above a top surface of the base; and a stake extending through the base to secure the device on the bed.

17. The device of claim 16 wherein the legs include a notch to receive a concrete forming member, a re-bar, or a dowel.

18. The device of claim 16 wherein each leg includes at least one arm extending laterally outwardly from the leg.

19. The device of claim 16 wherein the base and legs form an inverted T cross-section.

20. The device of claim 16 wherein the base and legs form an L cross-section.

21. A device for inducing cracking and providing drainage in concrete, comprising:

an extruded member having an integrally formed base, a pair of legs and drain channel;

the base having a flat bottom to sit upon a bed upon which concrete is to be poured such that the device is self-standing and extends continuously across the bottom of the drain channel;

the pair of legs each having a planar face extending a length upwardly from the base to a top edge;

the drain channel between the base and the legs and having at least one open end to drain fluid from the channel;

wherein the legs initially engage one another along the planar face and then spread apart as the concrete cures so as to induce a crack in the concrete and to define a gap between the legs communicating with the drainage channel to drain moisture which enters the crack; and wherein the drain channel is integrally formed into the extruded member between the base and the legs from a lower end of each of the legs to a top surface of the base which extends outwardly from a bottom of the drain channel.

* * * * *